US010545449B2

(12) United States Patent
Ozawa

(10) Patent No.: US 10,545,449 B2
(45) Date of Patent: Jan. 28, 2020

(54) FEEDING APPARATUS AND IMAGE FORMING SYSTEM

(71) Applicant: CANON FINETECH NISCA INC., Misato-shi (JP)

(72) Inventor: Masatoshi Ozawa, Yamanashi-ken (JP)

(73) Assignee: Canon Finetech Nisca Inc., Misato-shi (JP)

( * ) Notice: Subject to any disclaimer, the term of this patent is extended or adjusted under 35 U.S.C. 154(b) by 0 days.

(21) Appl. No.: 16/100,901

(22) Filed: Aug. 10, 2018

(65) Prior Publication Data

US 2019/0064729 A1 Feb. 28, 2019

(30) Foreign Application Priority Data

Aug. 30, 2017 (JP) ..... 2017-166059

(51) Int. Cl.
*G03G 21/16* (2006.01)

(52) U.S. Cl.
CPC ..... *G03G 21/1647* (2013.01); *G03G 21/1695* (2013.01)

(58) Field of Classification Search
CPC ..... G03G 15/6528; G03G 2215/0054; G03G 2215/0154; G03G 2221/1651; G03G 2221/1654; G03G 2221/1884; B65H 1/00; B65H 5/06; B65H 2402/441; B65H 2406/61
See application file for complete search history.

(56) References Cited

U.S. PATENT DOCUMENTS

| | | | | |
|---|---|---|---|---|
| 5,765,825 | A * | 6/1998 | Watase | B65H 1/08 271/162 |
| 7,431,287 | B2 * | 10/2008 | Hayashi | B65H 1/26 271/162 |
| 9,983,535 | B2 | 5/2018 | Ozawa | |
| 10,025,262 | B2 * | 7/2018 | Masuta | G03G 21/1647 |
| 2007/0296135 | A1 * | 12/2007 | Takahagi | G03G 15/6502 271/10.01 |
| 2012/0141158 | A1 * | 6/2012 | Yamauchi | G03G 21/1633 399/110 |
| 2014/0212167 | A1 * | 7/2014 | Agata | G03G 21/1647 399/107 |

FOREIGN PATENT DOCUMENTS

JP 2010-050845 A 3/2010

* cited by examiner

*Primary Examiner* — Francis C Gray
(74) *Attorney, Agent, or Firm* — Venable LLP

(57) ABSTRACT

A feeding apparatus comprises a locking unit for locking a connected state between an image forming apparatus and the feeding apparatus; an operating unit to which a force is applied in a separating direction in order to separate the feeding apparatus from the image forming apparatus and configured to perform an unlocking operation of unlocking the locking unit by being operated upon application of the force in the separating direction; and a handgrip unit provided at a position different from a position of the operating unit and to which a force is applied in the separating direction in order to separate the feeding apparatus from the image forming apparatus. The handgrip unit extends in a second horizontal direction perpendicular to a first horizontal direction and is arranged at a position at least partially overlapping a position where the operating unit is arranged with respect to the first horizontal direction.

20 Claims, 11 Drawing Sheets

FEEDING APPARATUS AND IMAGE FORMING SYSTEM

BACKGROUND OF THE INVENTION

Field of the Invention

The present invention relates to a feeding apparatus and an image forming system.

Description of the Related Art

Conventionally, in an image forming system such as a copying machine or a printer, a sheet conveying apparatus such as a feeding apparatus that supplies a sheet to an image forming apparatus is used.

The feeding apparatus is arranged side by side with the image forming apparatus, and the sheet is supplied into the image forming apparatus from an unloading port of the feeding apparatus connected to a loading port formed in the side portion of the image forming apparatus. Concerning movement of such an apparatus, for example, Japanese Patent Laid-Open No. 2010-50845 describes a technique of obtaining satisfactory user operability when moving the apparatus by providing the apparatus with a handle member which is attached for use only at the time of movement.

In a method of Japanese Patent Laid-Open No. 2010-50845, however, in order to improve operability when a user moves a large apparatus, the handle member needs to be attached before moving the apparatus. This takes time for preparation before movement and increases a cost by adding the handle member.

SUMMARY OF THE INVENTION

The present invention implements an improvement in operability by an arrangement without any additional component in a separation operation between a plurality of apparatuses.

According to one aspect of the present invention, there is provided a feeding apparatus capable of feeding a sheet to an image forming apparatus in connection with the image forming apparatus and moving in a separating direction of separating the feeding apparatus from the image forming apparatus in a first horizontal direction, the feeding apparatus comprising: a locking unit for locking a connected state between the image forming apparatus and the feeding apparatus; an operating unit to which a force is applied in the separating direction in order to separate the feeding apparatus from the image forming apparatus and configured to perform an unlocking operation of unlocking the locking unit by being operated upon application of the force in the separating direction; and a handgrip unit provided at a position different from a position of the operating unit and to which a force is applied in the separating direction in order to separate the feeding apparatus from the image forming apparatus, wherein the handgrip unit is arranged at a position at least partially overlapping a position where the operating unit is arranged in a second horizontal direction perpendicular to the first horizontal direction.

According to one aspect of the present invention, there is provided an image forming system comprising: an image forming apparatus configured to form an image; and a feeding apparatus capable of feeding a sheet to the image forming apparatus in connection with the image forming apparatus and moving in a separation direction of separating the feeding apparatus from the image forming apparatus in a first horizontal direction, wherein the feeding apparatus further includes: a locking unit for locking a connected state between the image forming apparatus and the feeding apparatus; an operating unit configured to perform an unlocking operation of unlocking the locking unit by being operated upon application of a force in the separation direction; and a handgrip unit provided at a position different from a position of the operating unit and to which a force is applied in the separation direction when separating the feeding apparatus from the image forming apparatus, the operating unit and the handgrip unit are arranged at a predetermined interval in the first horizontal direction of separating the feeding apparatus from the image forming apparatus, and the handgrip unit is arranged at a position at least partially overlapping a position where the operating unit is arranged in a second horizontal direction perpendicular to the first horizontal direction.

According to the present invention, it is possible to improve the operability by the arrangement without any additional component in the separation operation between the plurality of apparatuses.

Further features of the present invention will become apparent from the following description of exemplary embodiments with reference to the attached drawings.

DESCRIPTION OF THE EMBODIMENTS

Figure 1:
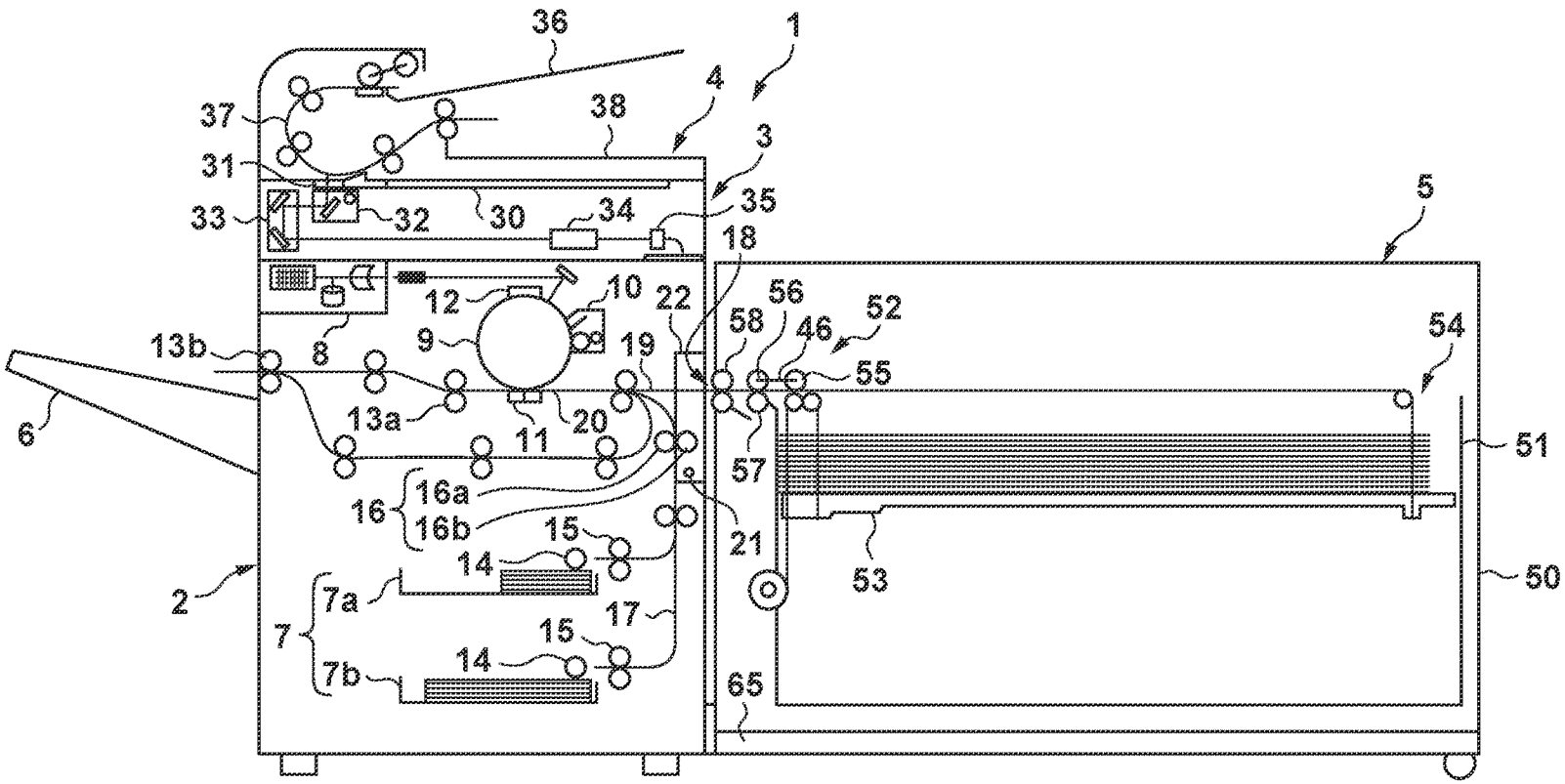
FIG. 1 is a view showing the schematic arrangement of an image forming apparatus and feeding apparatus.

Embodiments of the present invention will be described in detail below with reference to the accompanying drawings.

In the following description in this specification, a "sheet widthwise direction" means a direction crossing a sheet conveyance direction (in this embodiment, a description will be given as a direction perpendicular to the sheet conveyance direction) from a feeding apparatus 5 to an image forming apparatus 2.

First Embodiment

First, an example of the overall arrangement of an image forming system 1 will be described with reference to FIGS. 1 and 2. The image forming system 1 includes an image forming apparatus 2, an original reading apparatus 3, an original feeding apparatus 4, a feeding apparatus 5, and a sheet stacking apparatus 6. The image forming apparatus 2 includes a feeding cassette 7 (in an arrangement example shown in FIG. 1, two feeding cassettes 7*a* and 7*b*) capable of storing about 100 sheets. Based on image data read from an original image by the original reading apparatus 3, the image forming apparatus 2 performs image formation on a sheet fed from any one of the feeding cassettes 7*a* and 7*b*, and the feeding apparatus 5, and stacks and stores the sheet that has undergone image formation on the sheet stacking apparatus 6. It is also possible to feed an original sheet to the original reading apparatus 3 by the original feeding apparatus 4. Note that sheets handled in the image forming system 1 include an OHP sheet, tracing paper, coated paper, and the like in addition to plain paper. Moreover, a sheet size is not particularly limited, and it is possible to accept a plurality of types of sizes.

The image forming apparatus 2 is, for example, a copying machine, a printer, a facsimile apparatus, or the like and preferably installed on a floor surface so as not to be movable. The image forming apparatus 2 needs only to form an image on a sheet and can adopt various image forming mechanisms. For example, in this embodiment, an example is shown in which an electrostatic image forming mechanism is adopted as the image forming mechanism. However, the image forming mechanism of the image forming apparatus 2 is not limited to the electrostatic image forming mechanism and can also adopt an inkjet image forming mechanism, an offset image forming mechanism, and the like.

The image forming apparatus 2 includes a charger 12, a projector (a laser head or the like) 8, a photosensitive drum 9, a developing unit 10, a transfer charger 11, and fixing rollers 13*a*. The projector 8 forms an electrostatic latent image (still image) on the surface of the photosensitive drum 9 charged by the charger 12, and the developing unit 10 attaches toner to the electrostatic latent image. Furthermore, the transfer charger 11 transfers the toner attached onto the photosensitive drum 9 to a sheet supplied from the feeding cassettes 7*a* and 7*b* or feeding apparatus 5. The sheet to which the toner has been transferred is fed to the fixing rollers 13*a* arranged on a downstream side, and discharged to the sheet stacking apparatus 6 by a discharge roller pair 13*b* after the toner on the sheet is heated and fixed.

Each of the feeding cassettes 7*a* and 7*b* includes a delivery roller 14 that delivers a sheet in contact with the uppermost surface of the stored sheets and a separation roller pair 15 that separates the delivered sheets one by one to feed them. The sheets are fed from the feeding cassettes 7*a* and 7*b* by the delivery rollers 14 and separated one by one by the separation roller pairs 15. Furthermore, the separated sheet is conveyed via a cassette conveyance path 17 that extends along a side portion facing the feeding apparatus 5 by a conveyance roller pair 16 formed by a driving roller 16*a* and a driven roller 16*b*. Then, the sheet is fed to the transfer charger 11 along a conveyance path 20 after joining a loading path 19 communicating with an unloading port 18 of the feeding apparatus 5.

In the upper portion of the original reading apparatus 3, a first platen 30 and second platen 31 formed by transparent glass are juxtaposed in a horizontal direction. The first platen 30 is used to read an original set manually and formed with a size capable of placing an original of a maximum acceptable size. The second platen 31 is used to read an original which is fed from the original feeding apparatus 4 and moves at a predetermined speed.

A first reading carriage 32, a second reading carriage 33, and a photoelectric conversion means including a condenser lens 34 and a photoelectric conversion element 35 are provided inside the original reading apparatus 3. The first reading carriage 32 and the second reading carriage 33 are driven by a carriage motor (not shown) and move reciprocally in a sub-scanning direction below the first platen 30. The first reading carriage 32 includes a lamp that emits light to an original and a mirror that reflects the light reflected from the original. The second reading carriage 33 includes two mirrors that guide light from a mirror of the first reading carriage 32 to the condenser lens 34 and photoelectric conversion element 35. When reading an original on the first platen 30, light irradiation is performed from the first reading carriage 32 to an image of an original placed on the first platen 30 while moving the first reading carriage 32 and the second reading carriage 33. Then, the light reflected from the original is guided to the photoelectric conversion element 35 via the first reading carriage 32 and the second reading carriage 33. Then, the photoelectric conversion element 35 generates image data from the original by converting accepted light into an electrical signal. The image data thus generated is transmitted to the projector 8 of the image forming apparatus 2 as an image signal.

The original feeding apparatus 4 includes a feeding tray 36, a sheet conveyance mechanism 37, and a discharge tray 38, conveys originals placed on the feeding tray 36 one by one by the sheet conveyance mechanism 37, passes each sheet on the second platen 31, and discharges it to the discharge tray 38. Note that when reading an original fed from the original feeding apparatus 4 and passing on the second platen 31, the first reading carriage 32 and the second reading carriage 33 are stopped in advance below the second platen 31. Then, the original reading apparatus 3 generates image data from the original passing on the second platen 31.

The feeding apparatus 5 includes a housing (feeding apparatus main body) 50, a storage 51, and a separation/feed mechanism 52. The storage 51 functions as a placement unit which is supported in the housing 50 to be withdrawn by a withdrawal mechanism (not shown) and places sheets. The separation/feed mechanism 52 separates the sheets in the storage 51 one by one and supplies each sheet to the image forming apparatus 2. A stacking tray 53 serving as a vertical moving unit vertically movable in a vertical direction is provided in the storage 51. The stacking tray 53 is a tabular plate, and sheets can be stacked on the stacking tray 53. A sheet upper surface detection sensor (not shown) that detects the position of an uppermost surface of the sheets stacked on the stacking tray 53 is provided in the upper portion of the storage 51. Then, a vertical moving mechanism 54 moves the stacking tray 53 in accordance with the position of the uppermost surface of the sheets.

Figure 3:
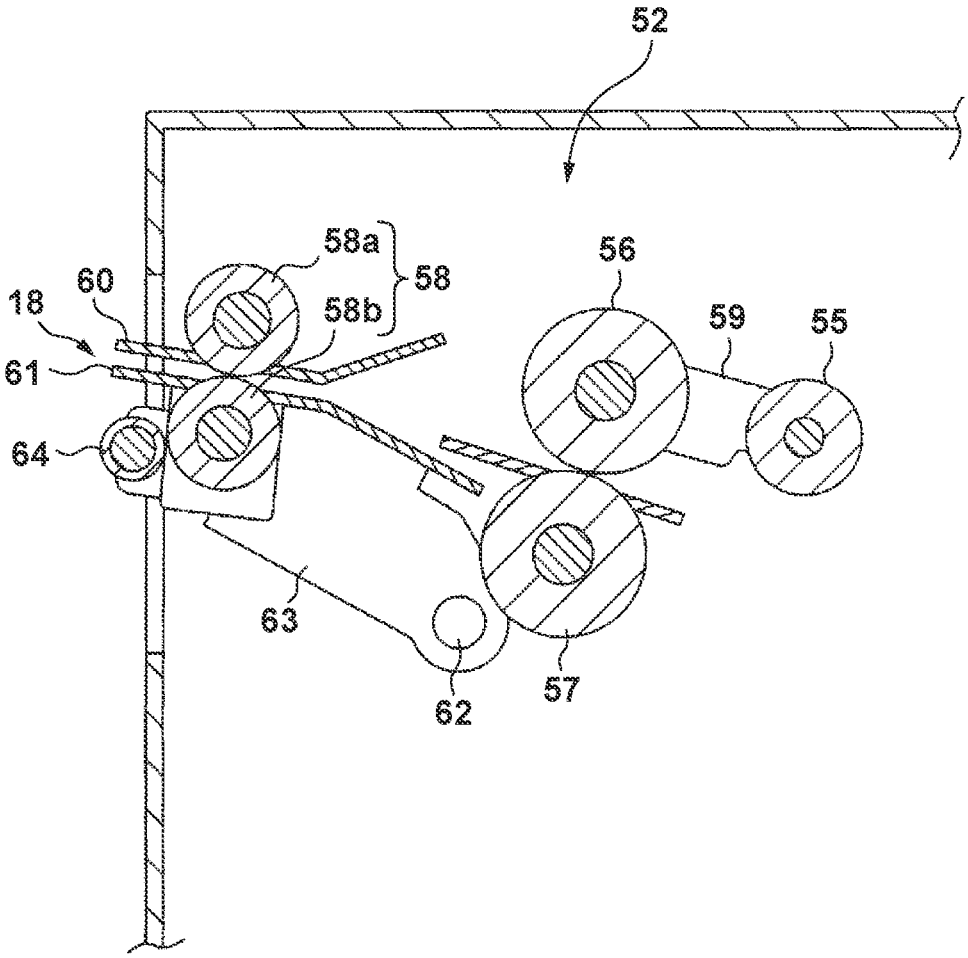
FIG. 3 is a view showing the details of a feed/conveyance unit of the feeding apparatus.

FIG. 3 shows the detailed arrangement of the separation/feed mechanism 52 in the feeding apparatus 5. The separation/feed mechanism 52 includes a delivery roller 55 that delivers a sheet in contact with the uppermost surface of the sheets stacked on the stacking tray 53, a separation means for separating the sheets one by one and feeding each sheet, and a conveyance roller pair 58 that conveys each sheet separated by the separation means to the image forming apparatus 2. The separation means is formed by a feeding roller 56, and a separation roller 57 which is pressed against the feeding roller 56 and prevents supply of the second and subsequent sheets.

The feeding roller 56 is driven by a feeding motor (not shown) via a plurality of gears and a timing belt (not shown), and rotates and supplies a sheet by driving by the feeding motor (not shown). The delivery roller 55 is rotatably supported by a bracket 59 pivotably supported around a shaft of the feeding roller 56 as shown in FIG. 3. The delivery roller 55 is rotationally driven by transmitting the rotation of the shaft of the feeding roller 56 by the feeding motor (not shown) via the plurality of gears.

A torque limiter (not shown) is mounted on the rotating shaft of the separation roller 57. This prevents supply of the second and subsequent sheets from above after the separation roller 57 is stopped when two or more sheets are overlapped and nipped in a press-contact portion between the feed roller 56 and the separation roller 57. That is, when a plurality of sheets overlap and enter a nip portion between the feeding roller 56 and the separation roller 57, a driving force of the feeding roller 56 is transmitted to the uppermost sheet. On the other hand, the rotation of the separation roller 57 is stopped, a slip occurs between the uppermost sheet and the second and subsequent sheets from above, and the uppermost sheet and the second and subsequent sheets are separated from each other. Of course, another member such as a separation pad may be used instead of the separation roller 57.

The conveyance roller pair 58 is formed by a driving roller 58*a* which is driven by a conveyance motor (not shown), and a driven roller 58*b* which rotates in accordance with the driving roller 58*a*. The driving roller 58*a* rotates by the conveyance motor (not shown), a sheet is discharged from the unloading port 18 of the feeding apparatus 5, and this sheet is supplied to the image forming apparatus 2.

The separation/feed mechanism 52 further includes an upper guide 60 and a lower guide 61 which are provided facing each other in order to form a conveyance path that guides a sheet.

Figure 2:
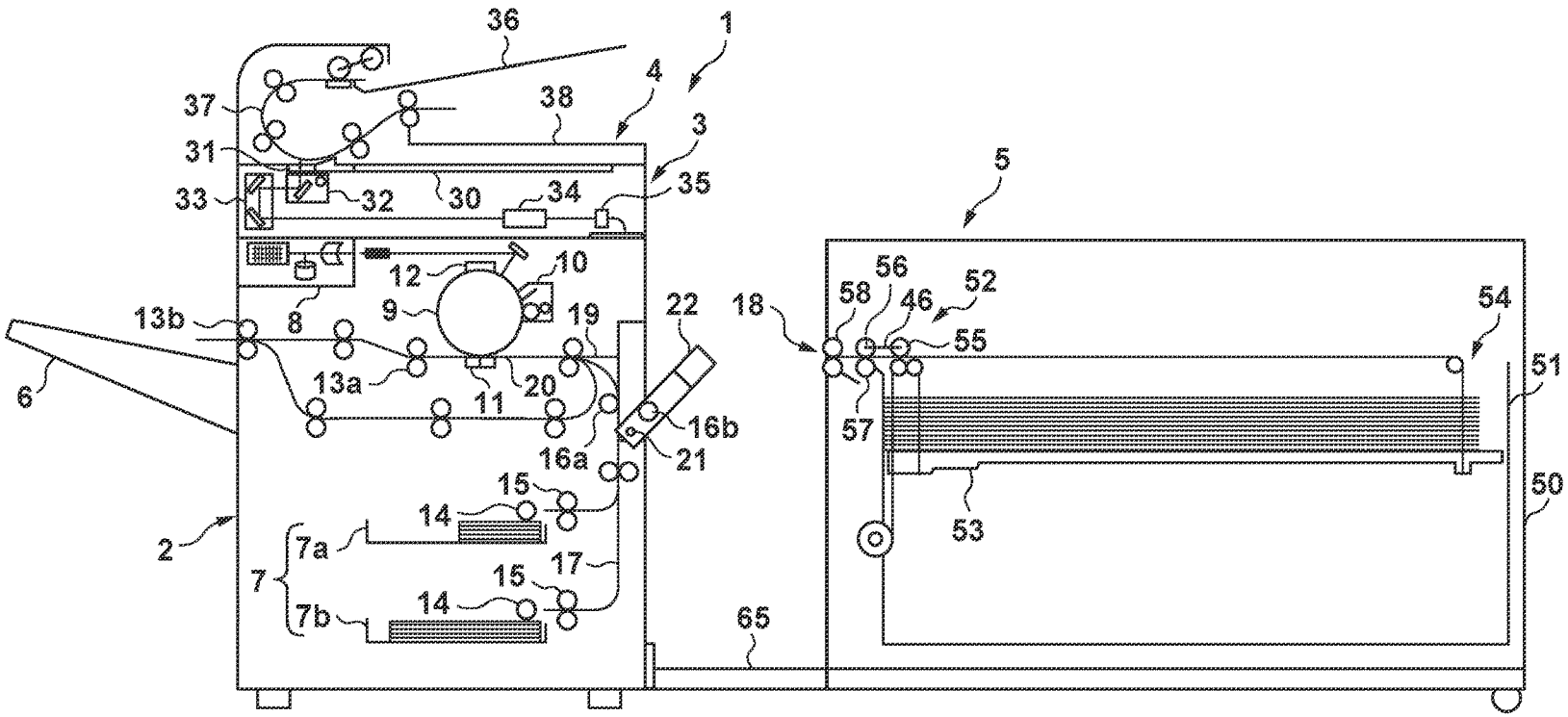
FIG. 2 is a schematic view showing a state in which the feeding apparatus is released from the image forming apparatus.

As shown in FIGS. 1 and 2, in the side portion of the image forming apparatus 2 facing the feeding apparatus 5, an opening/closing cover 22 is provided, which is pivotal about an opening/closing rotating shaft 21 between an open position where the interior of the image forming apparatus 2 is opened and a closed position where the interior of the image forming apparatus 2 is covered. A part of the cassette conveyance path 17 that includes the driven roller 16*b* is formed so as to move integrally with the opening/closing cover 22.

Figure 10:
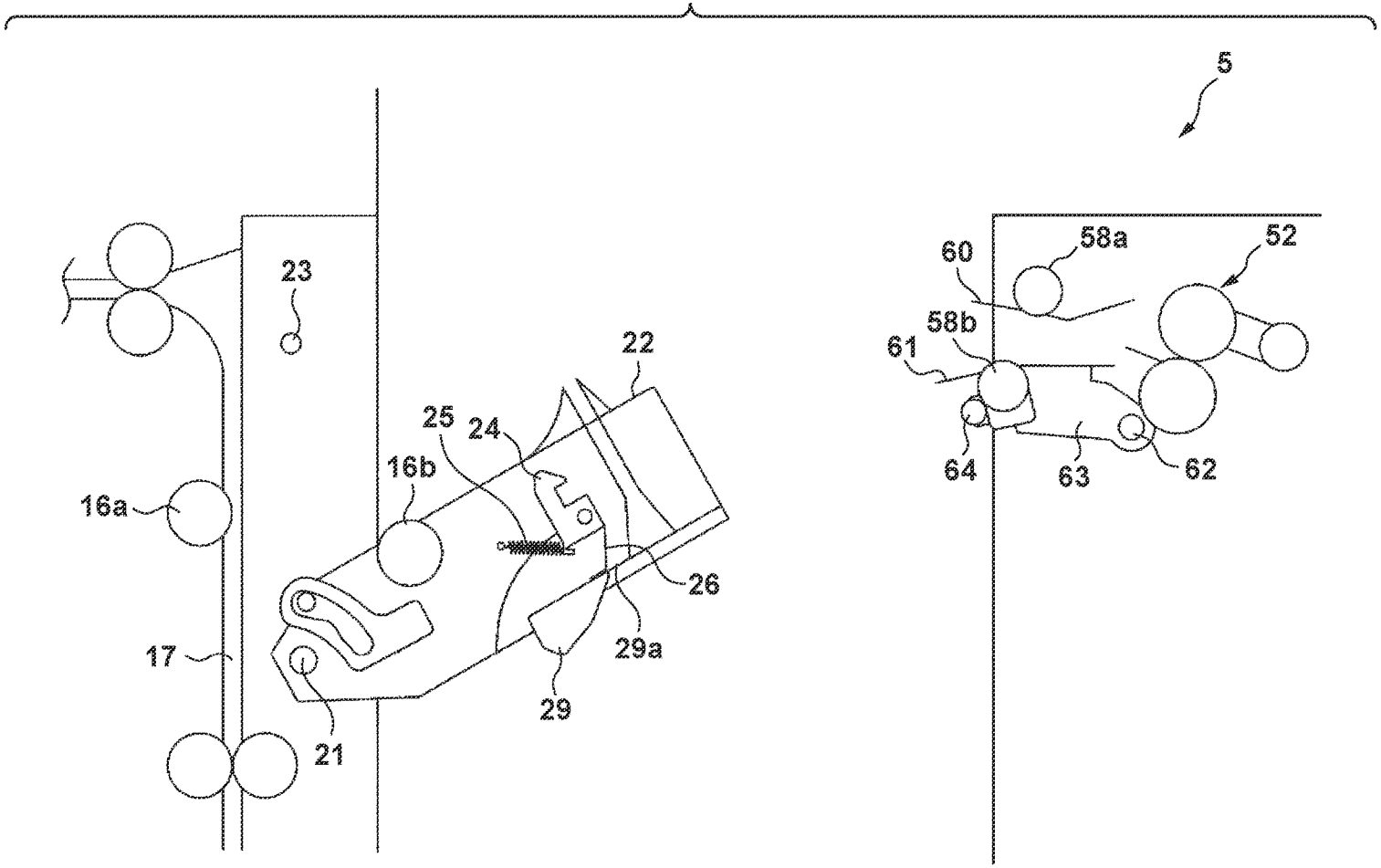
FIG. 10 is a view showing the details of a connecting portion where the feeding apparatus is released from the image forming apparatus.

The feeding apparatus 5 thus arranged is provided to be releasable from the image forming apparatus 2 installed on the floor surface so as not to move. As shown in FIG. 10, an arrangement is made to make it possible to open the cassette conveyance path 17 by opening the opening/closing cover 22 of the image forming apparatus 2 by releasing the feeding apparatus 5 from the image forming apparatus 2 or open the unloading port 18 by pivoting the lower guide 61 of the feeding apparatus 5 in a direction of separating it from the upper guide 60. This arrangement makes it easier to cope with paper jam or the like.

When the feeding apparatus 5 is released from the image forming apparatus 2, an assembly made of a guide block 63, the lower guide 61, the driven roller 58*b* of the conveyance roller pair 58, and an induction roller 64 pivots downward about a block pivot shaft 62 by its own weight. Consequently, the lower guide 61 and the driven roller 58*b* are separated from the upper guide 60 and the driving roller 58*a*, opening the unloading port 18 largely. Therefore, it becomes easier to remove a sheet jammed in a conveyance path of the separation/feed mechanism 52.

When the feeding apparatus 5 is thus released from the image forming apparatus 2, as shown in FIG. 10, it is possible to open the cassette conveyance path 17 by pivoting the opening/closing cover 22 provided in the side portion of the image forming apparatus 2 to the open position. By opening the cassette conveyance path 17 by opening the opening/closing cover 22 as described above, it becomes easier to remove a sheet jammed in the cassette conveyance path 17.

In this embodiment, the feeding apparatus 5 is installed on a guide rail 65, making it possible to separate/bring the feeding apparatus 5 from/close to the image forming apparatus 2 while being guided along the guide rail 65. FIG. 1 shows a state in which the image forming apparatus 2 and the feeding apparatus 5 are connected to each other. FIG. 2 shows a state in which the image forming apparatus 2 and the feeding apparatus 5 are separated from each other.

Figure 4:
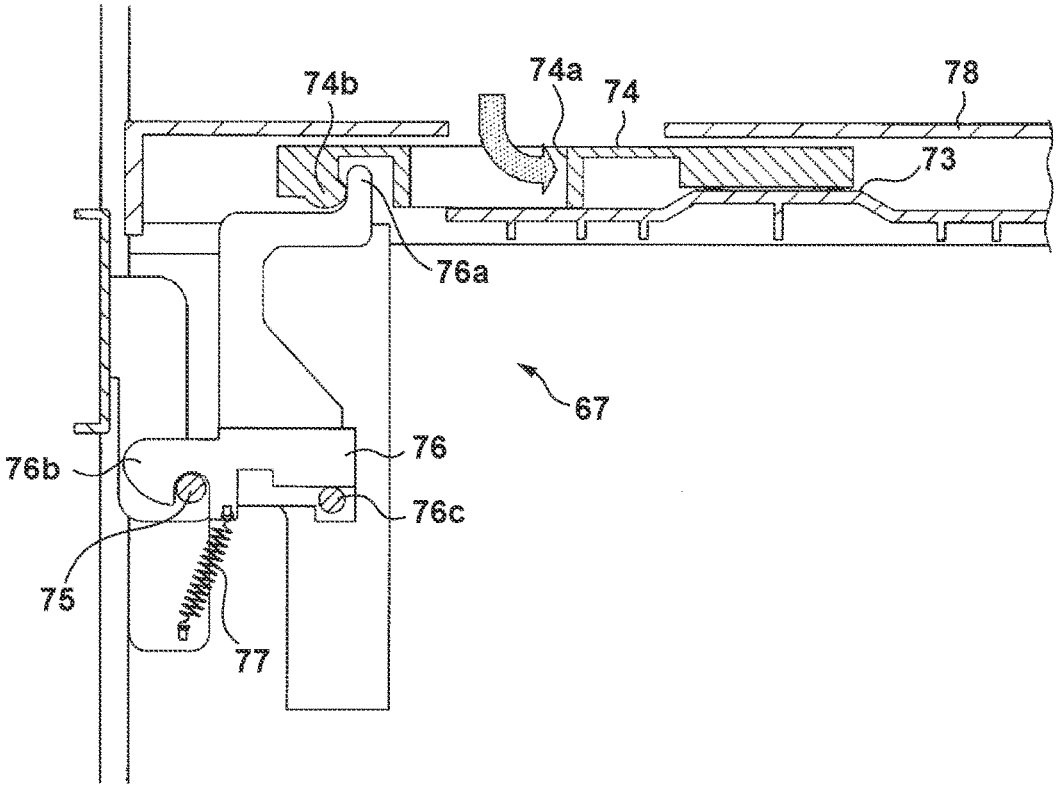
FIG. 4 is a view showing the details of a separation unlocking operating unit.
Figure 5:
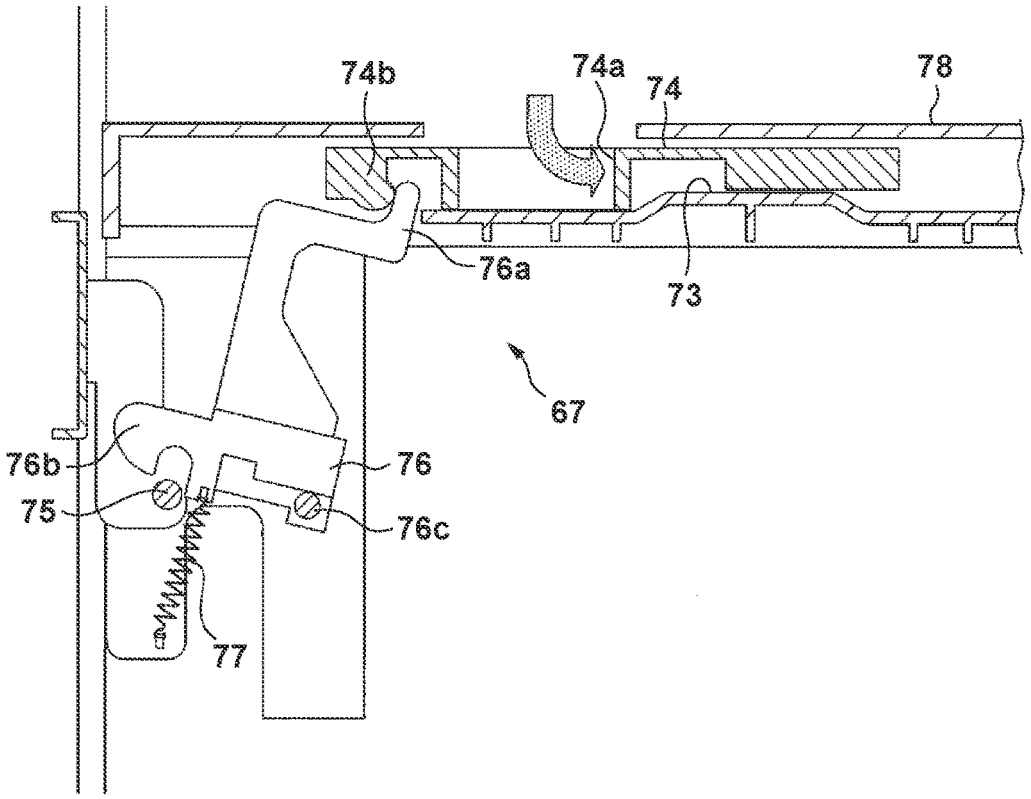
FIG. 5 is a view showing the details of a separation unlocked state.

The image forming system 1 according to this embodiment includes a connection holding mechanism (locking means) 67 shown in FIGS. 4 and 5. The connection holding mechanism 67 maintains a connected state of the feeding apparatus 5 to the image forming apparatus 2. By operating the connection holding mechanism 67, it is possible to release the feeding apparatus 5 from the image forming apparatus 2 in a separation direction.

The connection holding mechanism 67 is provided in the upper portion of one end portion (more specifically, the end portion on an operator side) of the feeding apparatus 5 in a sheet widthwise direction perpendicular to a sheet feeding direction.

Referring to FIGS. 4 and 5, the connection holding mechanism 67 is formed by an operating member 74, a lock claw 76, and a biasing member 77. The operating member 74 is movable along a guiding portion 73 formed in the upper portion of the feeding apparatus 5. The lock claw 76 is pivotably supported by a rotating shaft 76*c* between an engaging position at which it engages with a locking pin 75 and a disengaging position at which the lock claw 76 is disengaged from the locking pin 75. The biasing member 77 biases the lock claw 76 so as to make it pivot in a direction toward the engaging position. The locking pin 75 is provided to project from the side portion of the image forming apparatus 2 facing the feeding apparatus 5, and engages with the lock claw 76 in a mode in which it is inserted in the feeding apparatus 5 when the image forming apparatus 2 and the feeding apparatus 5 are connected to each other.

The operating member 74 includes an operating portion 74*a* which is exposed from an opening portion formed in an upper cover 78 of the feeding apparatus 5 and an engaging portion 74*b* formed in a distal end portion. Then, an operator operates (grips) the operating portion 74*a* manually, making it possible to slide the operating member 74 along the guiding portion 73.

A disengaging operation of the locking pin 75 and lock claw 76 will be described. The engaging portion 74*b* engages with a shift lever portion 76*a* formed in the lock claw 76. By sliding the operating member 74, as shown in FIG. 5, the engaging portion 74*b* presses the shift lever portion 76*a* about a rotating shaft 76*c* clockwise in FIG. 5, and the lock claw 76 is pivoted toward the disengagement position against the biasing member 77. Consequently, the locking pin 75 and the lock claw 76 are disengaged from each other. Note that the rotating shaft 76*c* extends in a direction crossing a predetermined surface that spreads in a sheet conveyance direction and a vertical direction.

A connection operation of the locking pin 75 and lock claw 76 will be described next. By moving the feeding apparatus 5 in a direction to connect to the image forming apparatus 2, the distal end portion 76*b* of the lock claw 76 abuts against the locking pin 75, and the lock claw 76 pivots in a clockwise direction in FIG. 4 against a force of the biasing member 77. Consequently, the distal end portion 76*b* of the lock claw 76 passes over the locking pin 75, a concave portion of the lock claw 76 fits in the locking pin 75, and the lock claw 76 and the locking pin 75 engage with each other.

Note that sets of the locking pins 75, lock claws 76, and biasing members 77 are preferably provided in two end portions of the feeding apparatus 5 in the sheet widthwise direction. In this case, by extending the rotating shaft 76*c* in the sheet widthwise direction, and connecting the lock claws 76 at the two end portions on a front side and a rear side by the rotating shaft 76*c*, the locking pins 75 and the lock claws 76 on both sides in the sheet widthwise direction are disengaged from each other by the operation of the operating member 74 on the front side.

By providing this connection holding mechanism 67, it is possible to keep the state in which the image forming apparatus 2 and the feeding apparatus 5 are connected to each other against a force in a direction of releasing the feeding apparatus 5 from the image forming apparatus 2.

A release operation of the image forming apparatus 2 and feeding apparatus 5 in the image forming system 1 according to this embodiment will be described next.

In the state in which the image forming apparatus 2 and the feeding apparatus 5 of the image forming system 1 are connected to each other (FIG. 1), the lock claw 76 of the connection holding mechanism 67 provided in the feeding apparatus 5 engages with the locking pin 75 inserted in the feeding apparatus 5 to project from the side portion of the image forming apparatus 2 at the engaging position. Accordingly, the image forming apparatus 2 and the feeding apparatus 5 maintain the connected state against a force of releasing the image forming apparatus 2 and the feeding apparatus 5 from each other by a pressing member (not shown) (FIG. 4).

When the image forming apparatus 2 and the feeding apparatus 5 are in a connected state, the operating portion 74*a* of the operating member 74 exposed from the opening portion formed in the upper cover 78 of the feeding apparatus 5 slides the operating member 74 along the guiding portion 73. At this time, by engagement between the engaging portion 74*b* of the operating member 74 and the shift lever portion 76*a* of the lock claw 76, the lock claw 76 pivots toward the disengagement position, disengaging the locking pin 75 and the lock claw 76 from each other. Consequently, the feeding apparatus 5 is disconnected from the image forming apparatus 2, allowing the feeding apparatus 5 to move in the separation direction from the image forming apparatus 2.

As described above, if the connected and held state between the image forming apparatus 2 and the feeding apparatus 5 by the connection holding mechanism 67 is canceled, it becomes possible to move, along the guide rail 65, the feeding apparatus 5 that has become movable in a direction of being released from the fixed image forming apparatus 2.

If a user operates only the operating member 74, however, in order to release and move the feeding apparatus 5 in the separation direction from the image forming apparatus 2, user operability is deteriorated from the viewpoint of its weight or an apparatus size, which is not preferable from the viewpoint of usability.

Figure 6:
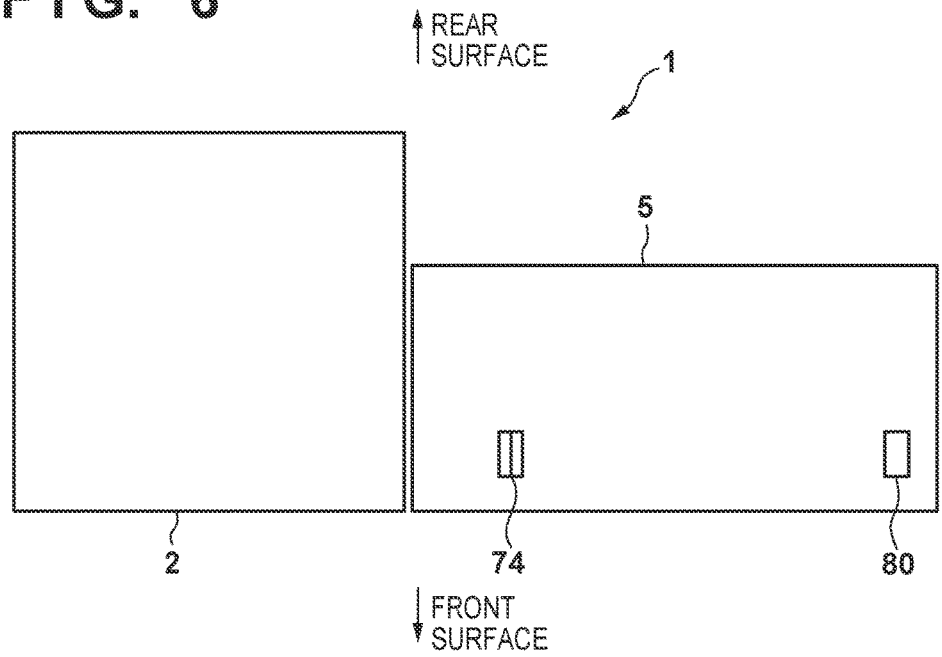
FIG. 6 is a view showing the schematic arrangement of the image forming apparatus and feeding apparatus when viewed from above.
Figure 7:
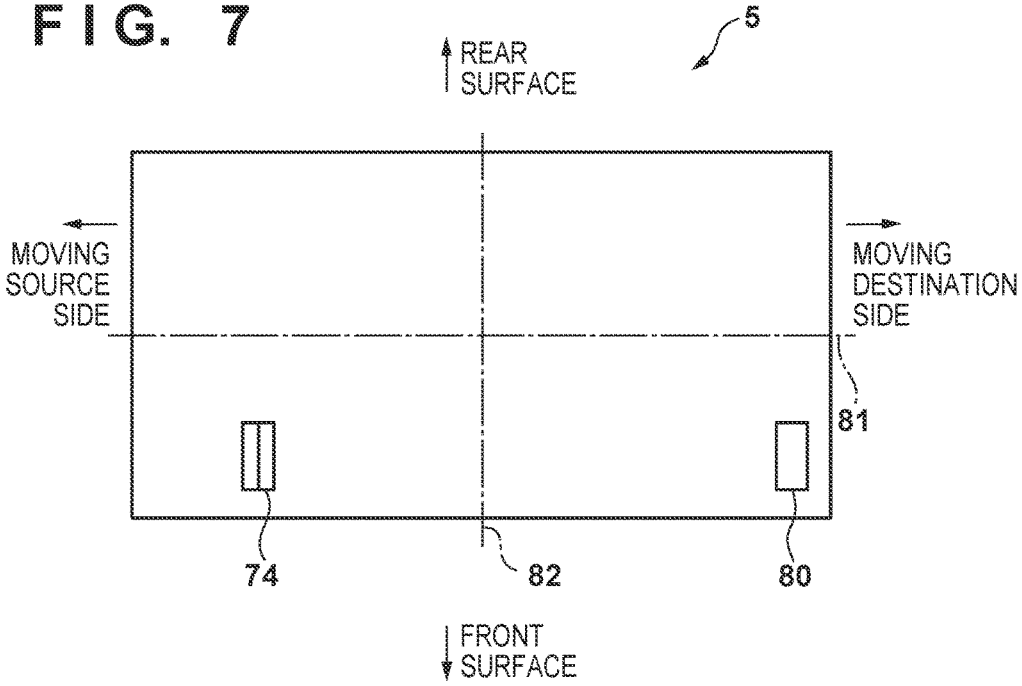
FIG. 7 is a schematic view showing an operating unit on the upper surface of the feeding apparatus.
Figure 8:
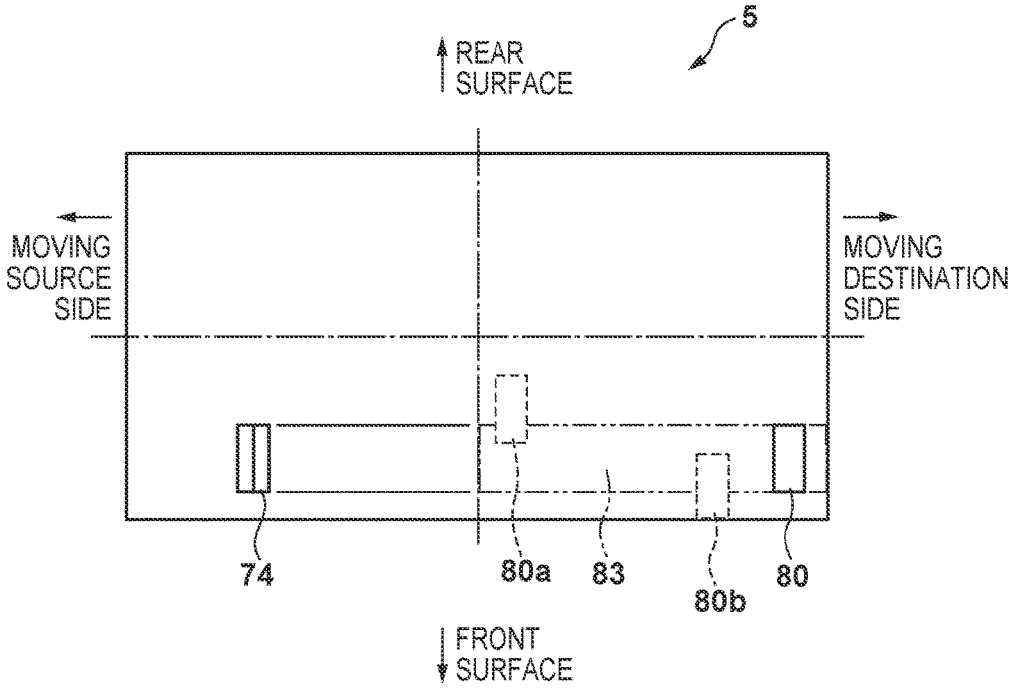
FIG. 8 is a schematic view showing an operating unit on the upper surface of the feeding apparatus.

To cope with this, an arrangement concerning this embodiment will be described with reference to FIGS. 6 to 8. Each of FIGS. 6 to 8 is a schematic view showing the image forming system 1 when viewed from above according to this embodiment. In this embodiment, in addition to the operating member 74 serving as the first handle unit, a handgrip unit 80 is provided in the upper cover 78 of the feeding apparatus 5 as the second handle unit. Then, when the feeding apparatus 5 is to be separated from the image forming apparatus 2, an arrangement is made so as to perform an operation without deteriorating the user operability by operating the handgrip unit 80 in addition to the operating member 74.

An arrangement configuration of the handgrip unit 80 in the feeding apparatus 5 according to this embodiment will be described. A description will be given below by setting a moving direction when the feeding apparatus 5 is separated from the image forming apparatus 2 to a moving destination side and a moving direction when the feeding apparatus 5 is attached to the image forming apparatus 2 to a moving source side. The handgrip unit 80 is formed integrally with the upper cover 78 (upper surface portion) of the feeding apparatus 5. Together with the operating member 74, the handgrip unit 80 is arranged on a side where the user operates at the time of the operation, at least on a side closer to a front surface than an anteroposterior center line 81 in a direction perpendicular to a direction capable of separating and moving the feeding apparatus 5. Furthermore, the handgrip unit 80 is arranged on a side closer to the moving destination side than a left-and-right center line 82 at least with respect to the direction capable of separating and moving the feeding apparatus 5. When the handgrip unit 80 is thus arranged, depending on the size of the feeding apparatus 5, a dimension that cannot be reached even if one user (for example, an adult of a general body type) stretches his/her both arms may be set. In such a case, it is considered that the feeding apparatus 5 is moved by the number of persons larger than one, and it is possible to obtain an effect of improving operability by the above-described arrangement even if the feeding apparatus 5 is moved by the large number of persons.

As shown in FIG. 8, the handgrip unit 80 is arranged at a position overlapping at least a part of an operating portion arrangement region 83 indicated by a two short dashed line in FIG. 8. The operating portion arrangement region 83 is equal to the operating member 74 in length in a longitudinal direction when viewed from the operator side and corresponds to all moving destination directions from the center of the feeding apparatus 5 in a right-and-left direction when viewed from the operator side. In other words, the handgrip unit 80 is arranged at a position overlapping at least a part of a region where the operating member 74 is projected in the right-and-left direction in the longitudinal direction when viewed from the operator side, on a side closer to the front surface than the center in the longitudinal direction when viewed from the operator side, and on a side closer to the moving destination than the center in the right-and-left direction when viewed from the operator side. Note that in the case of an example in FIG. 8, an example in which the operating member 74 and the handgrip unit 80 have the same horizontal and vertical sizes when viewed from above is shown. However, the present invention is not limited to this. The position of the handgrip unit 80 can be arranged so as to include at least the part of the operating portion arrangement region 83, and moved in the longitudinal direction or the right-and-left direction in FIG. 8. The handgrip unit 80 can be arranged at, for example, a position 80*a* or a position 80*b* indicated by a dotted line in FIG. 8.

An arrangement interval between the operating member 74 and the handgrip unit 80 is defined based on, for example, the size (the height, width, and depth) of the feeding apparatus 5, a standing position in operating both the operating member 74 and the handgrip unit 80 simultaneously when the operator separates the feeding apparatus 5, or the like.

Figure 9:
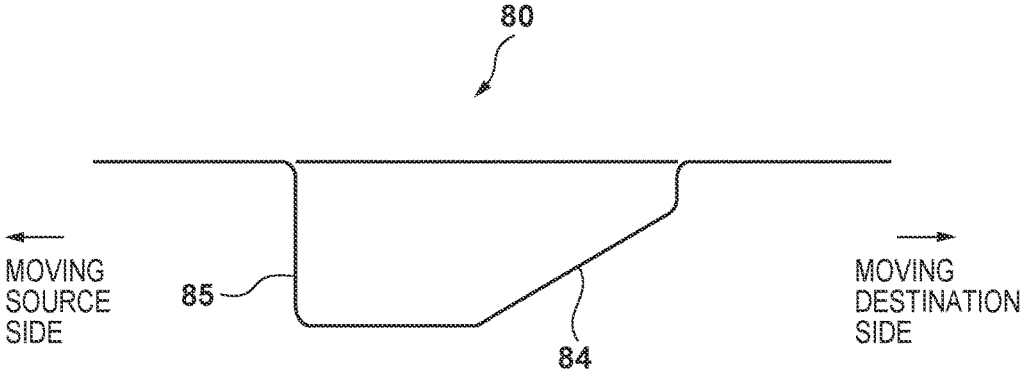
FIG. 9 is a sectional view showing the operating unit.

FIG. 9 is a view showing an example of the sectional shape of the handgrip unit 80. The handgrip unit 80 is formed by the same material integrally with the outer shape portion of the feeding apparatus 5. The sectional shape of the handgrip unit 80 when viewed from a front surface direction is a shape including a tilt portion 84 and an upright surface portion 85. The tilt portion 84 has a tilt from the moving source side to the moving destination side from downward to upward. The upright surface portion 85 is an almost perpendicular surface. The operator can apply a force by putting a hand to the tilt portion 84 when separating the feeding apparatus 5 from the image forming apparatus 2. Concerning a tilt angle of the tilt portion 84, it can be defined in consideration of the arrangement interval between the operating member 74 and the handgrip unit 80, the height of the feeding apparatus 5, or the like. In this embodiment, the depth of the handgrip unit 80 is formed in a range that does not influence a mechanism in the feeding apparatus 5. For example, the handgrip unit 80 may be formed in a range of the thickness of the upper cover 78.

By installing the above-described handgrip unit 80, the user operability when performing an operation of releasing the feeding apparatus 5 from the image forming apparatus 2 improves by operating the operating member 74 and the handgrip unit 80 as compared with a case in which an operation is performed only by the operating member 74.

Moreover, according to the present invention, it is possible to improve operability with a low cost and economized space without requiring an additional member.

Second Embodiment

The second embodiment according to an image forming system of the present invention will be described. Each of FIGS. 11 and 12 is a view showing an arrangement in which an operation panel (projecting portion) serving as a UI (User Interface) 110 is further installed in the arrangement of the image forming system 1 described in the first embodiment.

The UI 110 is installed to project toward the outside at a position, as its rough arrangement position, where a user of a general body type performs an operation or browsing easily on a screen when facing the front surface of an image forming system 1.

Figure 11:
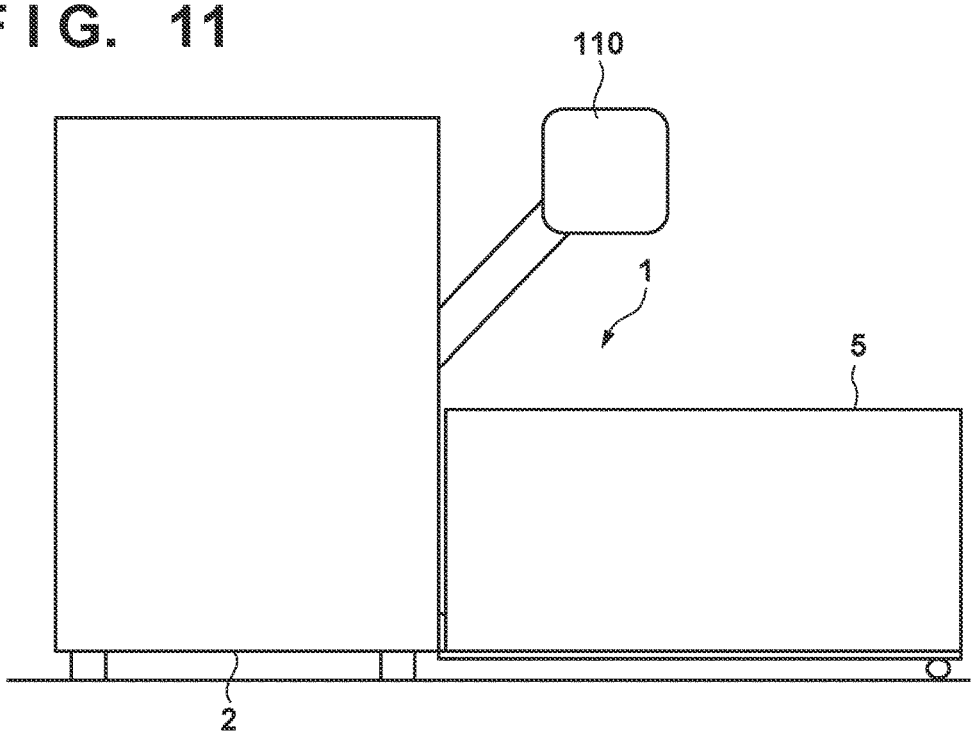
FIG. 11 is a view showing an example of the arrangement of an image forming system according to the second embodiment.
Figure 12:
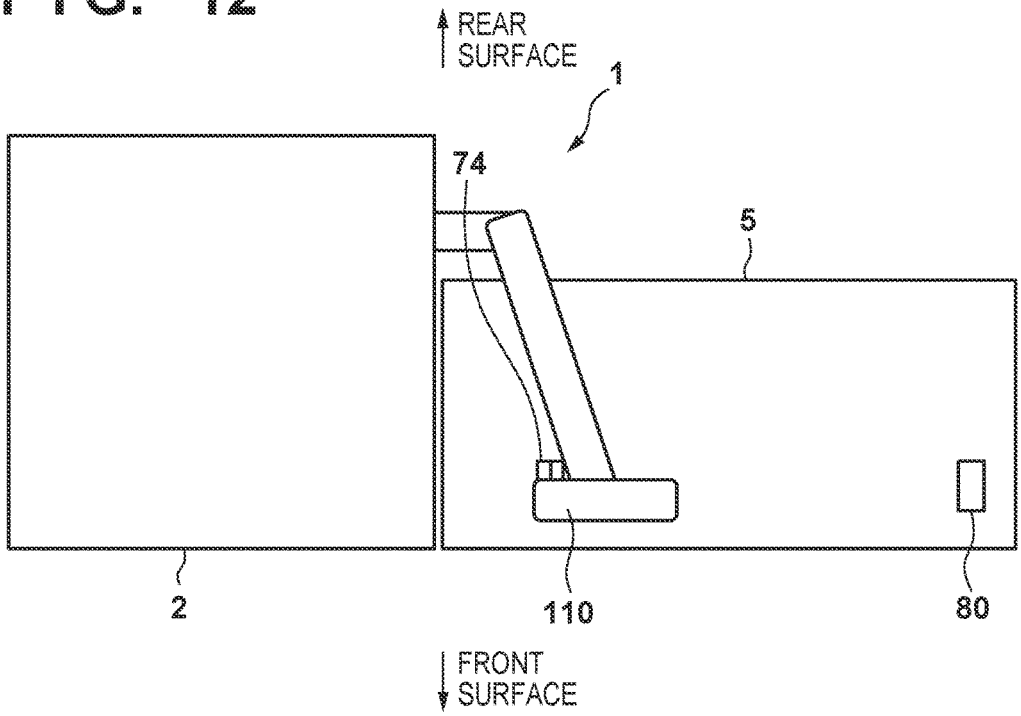
FIG. 12 is a view showing an example of the arrangement of the image forming system according to the second embodiment.
Figure 13:
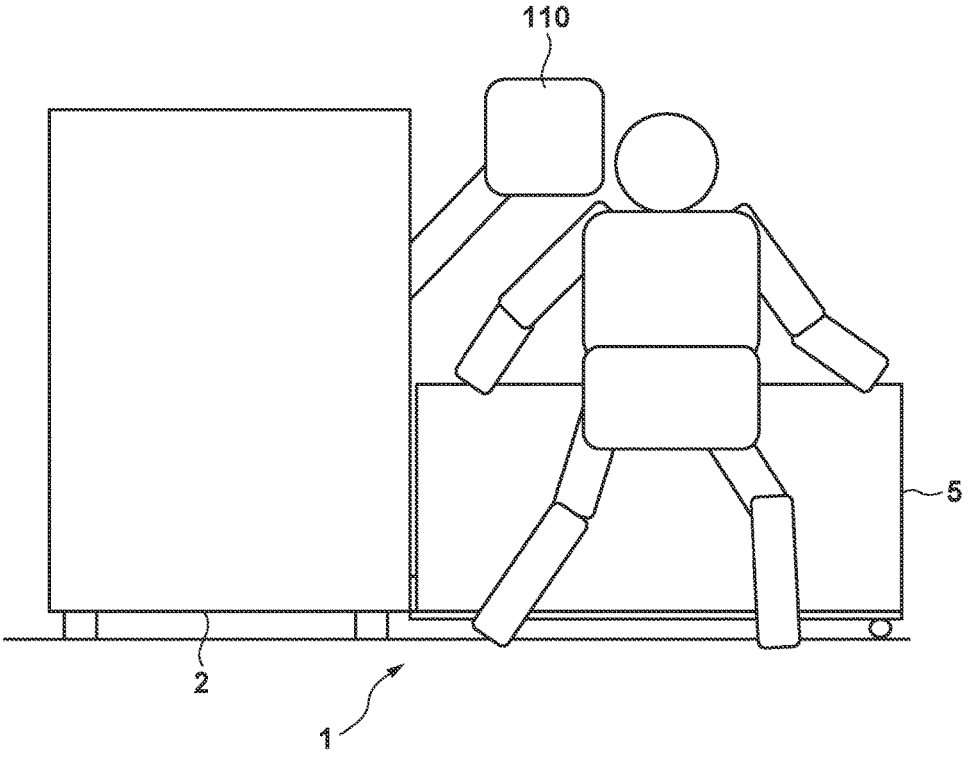
FIG. 13 is a view for explaining the timing of a separation operation of the image forming system according to the second embodiment.
Figure 14:
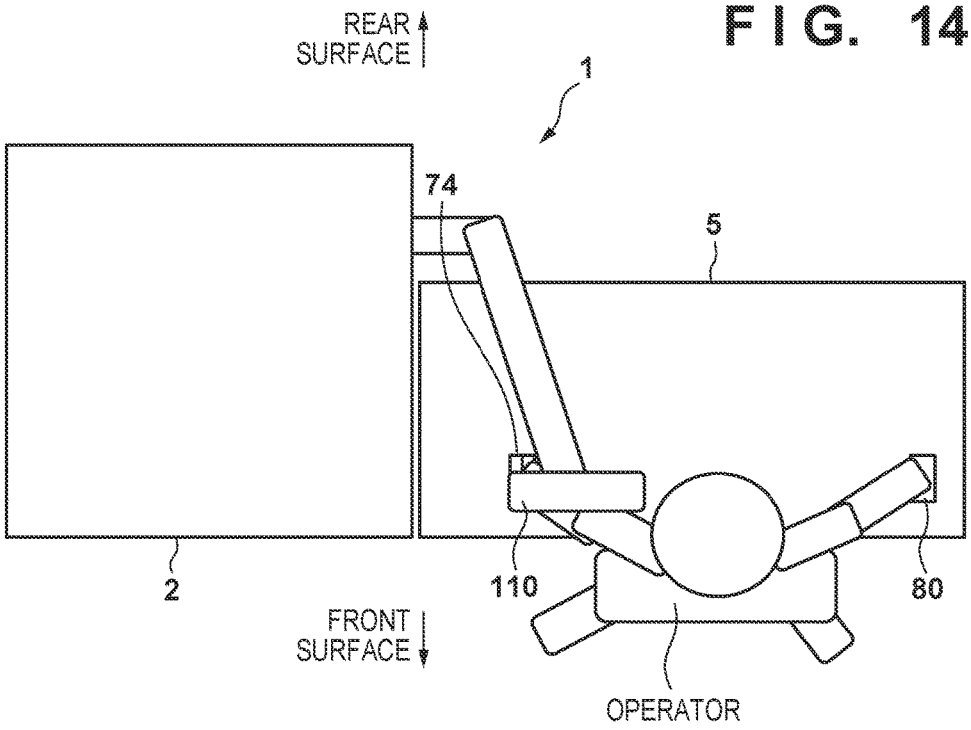
FIG. 14 is a view for explaining the timing of the separation operation of the image forming system according to the second embodiment.

Furthermore, each of FIGS. 13 and 14 is a view showing an operation state when separating a feeding apparatus 5 from an image forming apparatus 2 in the image forming system 1 having the arrangement in FIGS. 11 and 12. A description will be given here assuming that a user stands at almost the center of the feeding apparatus 5 a bit slouchingly.

As shown in FIGS. 13 and 14, the position of the first handle unit (operating member 74) is determined so the UI 110 does not impede a user operation when the user separates the feeding apparatus 5. Furthermore, the position of the second handle unit (handgrip unit 80) is determined in consideration of a positional relationship between the position of the first handle unit (operating member 74) and the position (posture) of the user at the time of an operation. A relationship between the first handle unit (operating member 74) and the second handle unit (handgrip unit 80) at this time is defined in consideration of the arrangements described with reference to FIGS. 7 and 8.

Figure 15:
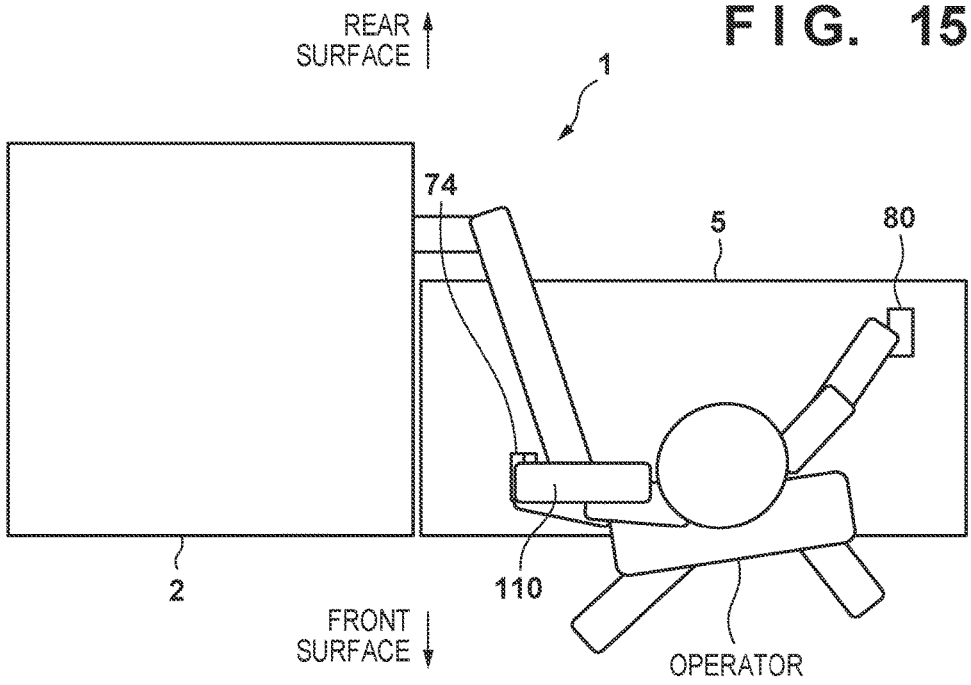
FIG. 15 is a view for explaining a comparative example with the image forming system according to the second embodiment.

FIG. 15 is a view showing an arrangement example to be compared with an arrangement between the first handle unit and the second handle unit according to this embodiment. In an arrangement shown in FIG. 15, the second handle unit (handgrip unit 80) is arranged on a side closer to a rear portion than a center in a longitudinal direction when viewed from an operator side and a side closer to a moving destination than the center in a right-and-left direction when viewed from the operator side. In this case, a force when the user separates the feeding apparatus 5 is not transmitted appropriately in a separation direction as compared with the arrangement according to this embodiment, degrading operability. Furthermore, by the arrangement of the projecting portion (the UI 110 or the like) of the image forming system 1, an operation when separating the feeding apparatus 5 is impeded, degrading the operability as compared with the arrangement according to this embodiment.

Note that in this embodiment, the description has been given by taking the UI 110 as an example of a member provided to project toward a user side (outside) in the image forming system 1. However, the present invention is not limited to this. The position of each handle unit may be decided in consideration of a relationship with an arrangement of, for example, another member (such as a button or a lever).

According to this embodiment, the arrangement of the handgrip unit 80 is installed in an operating portion arrangement region 83 in consideration of a case in which a member such as the UI projects from the image forming apparatus 2 to the side of the feeding apparatus 5. Consequently, the user adopts a very natural operational posture, making it possible to maintain operability satisfactorily without the image forming apparatus 2 or a projecting component colliding against a user body.

Another Embodiment

An operating portion handle by the present invention and the image forming system 1 using this have been described above with reference to the illustrated embodiments. However, the present invention is not limited to the illustrated embodiments. For example, in the above-described embodiments, the image forming apparatus 2 and the feeding apparatus 5 are connected to each other, and the operating member 74 (first handle unit) when unlocking this is installed on the top surface of the feeding apparatus 5 and the side of the image forming apparatus 2. However, the first handle unit may be provided on a moving destination direction side of a feeding apparatus 5, and arranged such that a positional relationship between the first handle unit and the second handle unit is reversed.

In the above-described embodiments, the handgrip unit 80 is formed by the same material integrated with the upper cover 78. However, the present invention is not limited to this, and, for example, in order to improve operability, a handgrip unit 80 may have a structure made of a different material. An example has been shown in which the handgrip unit 80 shown in the above-described embodiments has a rectangular shape when viewed from above as shown in FIG. 6. However, the present invention is not limited to this. The handgrip unit 80 may be formed, for example, as a shape including a curve conforming to the shape of a hand. In the above-described embodiments, an example has been shown in which the handgrip unit 80 has a shape with the upright surface portion 85 perpendicular (or almost perpendicular) to a horizontal plane as shown in FIG. 9. However, the present invention is not limited to this. Considering, for example, an interval between an operating member 74 and the handgrip unit 80, the size of the feeding apparatus 5, or the like, an arrangement having a tilt surface instead of an upright surface portion 85 may be adopted.

In the above-described embodiments, the second handle unit (handgrip unit 80) serves as an operating unit by providing a concave shape. However, the second handle unit may serve as a handle unit that operates the feeding apparatus 5 in a separation direction serving as the operating unit by providing a convex shape. Furthermore, it is also possible to further improve operability by arranging the second handle unit near the distal end of the feeding apparatus 5 in a moving destination direction, gripping it with the side surface at the distal end of the feeding apparatus 5 in the moving destination direction, and taking a handle-like form.

The second handle unit may be arranged such that an operator can change (adjust) the arrangement position in a range that does not require attachment or the like of a new member at the time of an operation. In the above-described embodiments, an example in which two handle units are used when separating the feeding apparatus 5 has been shown. However, an arrangement that provides more handle units different in arrangement interval may be adopted. For example, because the weight of the feeding apparatus 5 changes in accordance with the remaining amount of sheets stacked inside of the feeding apparatus 5, a force needed when separating the feeding apparatus 5 changes. It is therefore possible to further improve operability when separating the feeding apparatus 5 by allowing the operator to change a position at which a force is applied.

In the above-described embodiments, an example in which the second handle unit is adopted in the image forming system 1 including the image forming apparatus 2 and the feeding apparatus 5 has been shown. However, the second handle unit of the present invention is applicable to a system, other than an image forming system, which includes two or more apparatuses or units which can be connected/separated to/from each other and a system in various directions of the separation direction or the position of the operator as well, as a matter of course.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-166059, filed Aug. 30, 2017, which is hereby incorporated by reference herein in its entirety.

What is claimed is:

1. A feeding apparatus capable of feeding a sheet to an image forming apparatus when connected to the image forming apparatus and moving in a separating direction of separating the feeding apparatus from the image forming apparatus in a first horizontal direction, the feeding apparatus comprising:

a locking unit for locking a connected state between the image forming apparatus and the feeding apparatus;

a first handle unit to which a force is applied in the separating direction manually in order to separate the feeding apparatus from the image forming apparatus and configured to perform an unlocking operation of unlocking the locking unit by being operated upon application of the force in the separating direction; and a second handle unit provided at a position different from a position of the first handle unit and to which a force is applied in the separating direction manually in order to separate the feeding apparatus from the image forming apparatus, wherein, as viewed in the first horizontal direction, the second handle unit is arranged at a position at least partially overlapping a position where the first handle unit is arranged.

2. The apparatus according to claim 1, wherein the first handle unit and the second handle unit are arranged closer to a side where an operator operates the first handle unit than a center of the feeding apparatus with respect to the second horizontal direction.

3. The apparatus according to claim 1, wherein one of the first handle unit and the second handle unit is arranged at a position closer to a side of the image forming apparatus than a center of the feeding apparatus with respect to the first horizontal direction, and the other is arranged at a position farther away from the image forming apparatus than the center of the feeding apparatus.

4. The apparatus according to claim 1, wherein the second handle unit is arranged at a position farther away from the image forming apparatus than the first handle unit with respect to the first horizontal direction.

5. The apparatus according to claim 1, wherein the second handle unit is formed to have a concave shape.

6. The apparatus according to claim 1, wherein the second handle unit is formed to have a surface with an incline ascending in the separating direction.

7. The apparatus according to claim 1, wherein the second handle unit is formed to have a surface which is perpendicular to a horizontal plane on a side of the image forming apparatus with respect to the first horizontal direction.

8. The apparatus according to claim 1, wherein the first handle unit is arranged at a position farther away from the image forming apparatus than the second handle unit with respect to the first horizontal direction.

9. The apparatus according to claim 1, wherein the first handle unit and the second handle unit are formed in an upper surface portion of the feeding apparatus.

10. The apparatus according to claim 1, wherein the first handle unit and the second handle unit are formed between an upper surface portion of the feeding apparatus and an uppermost position when sheets are stacked in the feeding apparatus.

11. The apparatus according to claim 1, wherein the second handle unit is formed integrally with an outer portion of the feeding apparatus.

12. The apparatus according to claim 1, wherein the second handle unit is formed to have a convex shape in an upper surface portion of the feeding apparatus.

13. The apparatus according to claim 1, wherein the second handle unit further functions so as to perform the unlocking operation of the locking unit when separating the feeding apparatus from the image forming apparatus.

14. The apparatus according to claim 1, wherein the second handle unit comprises a plurality of second handle units in the first horizontal direction.

15. The apparatus according to claim 1, wherein the second handle unit is configured to be movable in the first horizontal direction.

16. The apparatus according to claim 1, wherein an interval between the first handle unit and the second handle unit is defined in accordance with a size of the feeding apparatus.

17. An image forming system comprising:

an image forming apparatus configured to form an image; and a feeding apparatus capable of feeding a sheet to the image forming apparatus when connected to the image forming apparatus and moving in a separating direction of separating the feeding apparatus from the image forming apparatus in a first horizontal direction, wherein the feeding apparatus comprises:

a locking unit for locking a connected state between the image forming apparatus and the feeding apparatus;

a first handle unit to which a force is applied in the separating direction manually in order to separate the feeding apparatus from the image forming apparatus and configured to perform an unlocking operation of unlocking the locking unit by being operated upon application of the force in the separating direction; and a second handle unit provided at a position different from a position of the first handle unit and to which a force is applied in the separating direction manually in order to separate the feeding apparatus from the image forming apparatus, wherein the first handle unit and the second handle unit are arranged at a predetermined interval in the first horizontal direction of separating the feeding apparatus from the image forming apparatus, and as viewed in the first horizontal direction, the second handle unit is arranged at a position at least partially overlapping a position where the first handle unit is arranged.

18. The system according to claim 17, wherein the image forming apparatus includes a projecting portion provided to project from the image forming system to an outside, and the first handle unit and the second handle unit are arranged at a position where an operation by an operator when separating the feeding apparatus from the image forming apparatus is not impeded by the projecting portion.

19. The system according to claim 17, wherein one of the first handle unit and the second handle unit is arranged at a position closer to a side of the image forming apparatus than a center of the feeding apparatus with respect to the first horizontal direction, and the other is arranged at a position farther away from the image forming apparatus than the center of the feeding apparatus.

20. The system according to claim 17, wherein the second handle unit is arranged at a position farther away from the image forming apparatus than the first handle unit with respect to the first horizontal direction.

* * * * *